United States Patent [19]

Motooka

[11] Patent Number: 4,957,280

[45] Date of Patent: Sep. 18, 1990

[54] UNIFORM SPEED PINLESS FOLDING MACHINE

[75] Inventor: Mikio Motooka, Mihara, Japan

[73] Assignee: Mitsubishi Jukogyo Kabushiki Kaisha, Tokyo, Japan

[21] Appl. No.: 293,831

[22] Filed: Jan. 5, 1989

[30] Foreign Application Priority Data

Jan. 11, 1988 [JP] Japan ..... 63-2433

[51] Int. Cl.[5] ..... B42C 1/04

[52] U.S. Cl. ..... 270/47; 270/21.1; 270/50; 493/356

[58] Field of Search ..... 270/4–10, 270/20.1, 21.1, 45, 47–51, 60; 493/356 X, 444, 357, 361

[56] References Cited

U.S. PATENT DOCUMENTS

| | | | |
|---|---|---|---|
| 4,094,499 | 6/1978 | Thomas | 270/60 |
| 4,279,410 | 7/1981 | Bolza-Schunemann | 493/444 |
| 4,295,644 | 10/1981 | van der Meulen | 270/60 |
| 4,445,881 | 5/1984 | Bullen et al. | 270/60 |
| 4,491,310 | 1/1985 | Reffert | 270/60 |
| 4,564,183 | 1/1986 | Muller | 270/21.1 |
| 4,564,470 | 1/1986 | Schmitt | 270/21.1 |

FOREIGN PATENT DOCUMENTS

| | | | |
|---|---|---|---|
| 3534157 | 4/1987 | Fed. Rep. of Germany | 270/47 |
| 2110191A | 6/1983 | United Kingdom | 270/4 |

*Primary Examiner*—Edward K. Look
*Assistant Examiner*—Therese M. Newholm
*Attorney, Agent, or Firm*—Wenderoth, Lind & Ponack

[57] ABSTRACT

The known pinless folding machine in the prior art is improved in that the speed-up conveyor belts therein is removed, the drive at an increased speed of the folding drum, the clamping drum and the conveyor belts is abolished, but instead, drive at the same speed as the web is effected for these three members. More particulary, there are provided a first cutter drum and a first cutter receiver drum, a second cutter receiver drum, a head end push-in drum, and drum-round conveyor belts wrapped around the folding drum and traveling at the same speed as the web. Cutting of the web is effected twice between the first cutter drum and the receiver drum therefor and between the second cutter receiver drum and a second cutter device disposed on the folding drum, and the web is perfectly cut by the second cutter device. Accordingly, perfect cutting of the web is effected on the folding drum. The head end of the cut web is pushed into the gap between the claws and the claw seats contained in the folding drum and disposed as aligned in a row directed in the axial direction of the folding drum by means of the push-in blades on the head end push-in drum. Constraint for the web upon push-in of its head end, is effected by the conveyor belts.

8 Claims, 3 Drawing Sheets

UNIFORM SPEED PINLESS FOLDING MACHINE

BACKGROUND OF THE INVENTION:

1. Field of the Invention:

The present invention relates to a pinless folding machine applicable to a rotary folding machine.

2. Description of the Prior Art:

At first, description will be made on one example of the known pinless folding machine in the prior art with reference to FIGS. 5 and 6. As shown in FIG. 5, in a pinless folding machine in the prior art, either a web (a web of paper) a twice-folded by a triangular plate 1 or a web b in an unfolded state passes through a pair of first nipping rollers 2 and a pair of second nipping rollers 3 which are rotating at the same peripheral speed as the web speed, and then it is cut by a cutting device consisting of a cutter drum 4 and a cutter receiver drum 5. This cut paper sheet (hereinafter called simply "sheet") is accelerated by a pair of speedup conveyor belts 6 and 6' guided by a pair of guide rollers 15 and 15', so that the interval between the preceding sheet and the succeeding web is broadened. Owing to existence of this broadened interval, the head end of the succeeding sheet can be clamped by means of a folding drum 7 and a claw 8 shown in FIG. 6 without being interfering with the tail end of the preceding sheet. The clamped sheet has its central portion of the cut length pushed into the gap between a clamping plate and its seat forming a clamping device 11 on a clamping drum 10 by means of a folding blade 9 of the folding drum 7 that is accelerated to have the same peripheral speed as the speed-up conveyor belts 6 and 6' to be twice-folded, and thereafter it is carried out to the outside of the folding machine by means of conveyor belts 12, a sheet discharge impeller 13 and a sheet discharge conveyor 14. While the head end of the web is paid off from the above-mentioned cutting device and enters between the pair of speed-up conveyor belts 6 and 6' before its tail end is cut, the head portion of the web is slipping with respect to the pair of speed-up conveyor belts 6 and 6' until the tail end of the web is cut. Subsequently, when the sheet has been cut and released from the web, the sheet is quickly accelerated by the speed-up conveyor belts 6 and 6' and is conveyed to the folding drum 7. In FIG. 6, the claw 8 serves to clamp the sheet between it and a claw seat 8', but unless a gap interval S broader than a back portion 8*a* is present, the back portion 8*a* would strike against the tail end of the preceding sheet. It is to be noted the sheet clamping surfaces of the claw 8 and the claw seat 8' conform to the circumferential surface of the folding drum 7.

The above-described pinless folding machine in the prior art inherently has the following disadvantages:

(1) Since the sheet is quickly accelerated (by 15–40%) from the web speed after the web (web of paper) has been cut, faults such as end-folding, especially end-folding of the opposite edge portions projecting from the speed-up conveyor belts, a poor folding precision of sheets, or the like are liable to occur.

(2) Due to the fact that while the sheet is pinched between the aforementioned belts and is being conveyed and slipping, it is quickly paid off (accelerated) after cutting of its tail end, the head end positions of the sheets would fluctuate, and so, the head end portions would not enter uniformly into a predetermined clamping zone of the claw. Accordingly, a folding precision is degraded.

(3) Since the web is made to slip with respect to the speed-up conveyor belts (before cutting at the tail end), there occurs faults such that patterns printed on the sheet are scratched by the belts.

(4) Since the web is cut while it is held between the speed-up conveyor belts and being made to slip with respect to the belts and after cutting it is conveyed as being pinched between the belts, severe adjustment of the belts is necessary, hence a lot of labor is spent for that purpose, and it is necessary to become skilled in the adjustment.

(5) As the sheet is cut out while the web is being made to slip between and with respect to the speedup conveyor belts, static electricity is liable to be generated, consequently sometimes the fluctuations of the head end position of the sheet as described in numbered paragraph (2) above may arise, and further in the event that a resistance force caused by static electricity is uneven in the widthwise direction of the web (in the axial direction of the folding drum), the sheet would be twisted and would be folded obliquely with respect to the edges of the sheet. In addition, it becomes difficult to correct the attitude of the sheet folded on the sheet discharge conveyor.

(6) Though the sheet enters into the folding drum as guided by the speed-up conveyor belts, when the sheets have clogged the passageway between the belts, it takes a lot of time for removing the clogged sheets, and so, an availability factor of the folding machine is lowered.

(7) Since the head end of the sheet is clamped by means of a plurality of claws on the folding drum that is rotating at the increased speed, end folding of the opposite edge portions of the sheet projecting from the claws at the opposite ends, and breaking and end folding of the sheet caused by inflation of the sheet end portions between the claws, are liable to occur. In addition, as the central portion of the cut sheet is folded under the accelerated condition, a folding precision is also liable to degraded.

The above-mentioned disadvantages (1) to (7) would be more and more deteriorated as the folding machine is speeded up.

SUMMARY OF THE INVENTION

It is therefore one object of the present invention to provide an improved pinless folding machine which can fold sheets cut from a web at a high folding precision without scratching patterns printed on the sheets, and without necessitating severe belt adjustment nor operator's skill in the adjustment.

In order to achieve the aforementioned object, according to the present invention, the speed-up conveyor belts in the known folding machine is removed, the drive at an increased speed of the folding drum, the clamping drum and the conveyor belts is abolished, but instead, drive at the same speed as the web is effected for these members. To the end, the following provisions are made according to one feature of the present invention:

(1) There are provided a first cutter drum and a first cutter receiver drum, a second cutter receiver drum, a head end push-in drum, and drumround conveyor belts wrapped around the folding drum and moving at the same speed as the web.

(2) Cutting of the web is effected twice between the first cutter drum and the receiver drum therefor and between the second cutter receiver drum and a second cutter device disposed on the folding drum, and the web is perfectly cut by the second cutter device. Accordingly, perfect cutting of the web is effected on the folding drum.

(3) The head end of the cut web is pushed into the gap between the claws and claw seats contained in the folding drum and disposed as aligned in a row directed in the axial direction of the folding drum by means of push-in blades on the head end push-in drum.

(4) Constraint for the web upon push-in of its head end, is effected by the conveyor belts.

In operation, the respective drums (the folding drum, clamping drum, head end push-in drum, first cutter drum and receiver drum therefor, and second cutter receiver drum), the respective rollers such as the first and second nipping rollers and the like, and all the other rotary members are rotated at the same peripheral speed as the web speed to cut the web, thus the sheet is conveyed by the clamping claws without broadening the interval between the sheets, and parallel folding can be carried out.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
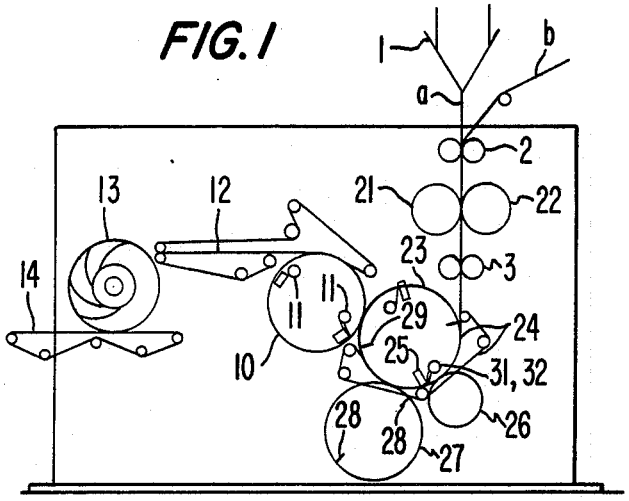
FIG. 1 is a schematic front view showing a drum arrangement in a uniform speed pinless folding machine according to one preferred embodiment of the present invention.

In FIGS. 1 to 4 which illustrate one preferred embodiment of the present invention, reference numeral 1 designates a triangular plate, numeral 2 designates first nipping rollers, numeral 3 designates second nipping rollers, numeral 10 designates a clamping drum, numeral 11 designates a clamping device, numeral 12 designates conveyor belts, numeral 13 designates a sheet discharge impeller, numeral 14 designates a sheet discharge conveyor, numeral 21 designates a first cutter drum, numeral 22 designates a first cutter receiver drum, numeral 23 designates a folding drum, numeral 24 designates a drumround conveyor belt, numeral 25 designates a second cutter device, numeral 26 designates a second cutter receiver drum, numeral 27 designates a head end push-in drum, numeral 28 designates a push-in blade, numeral 29 designates a folding blade device, numeral 31 designates a sawtooth cutter blade, numeral 32 designates clamping claws, numeral 33 designates claw seats, numeral 34 designates cutter receivers, and numeral 35 designates a head end of a web.

Figure 2:
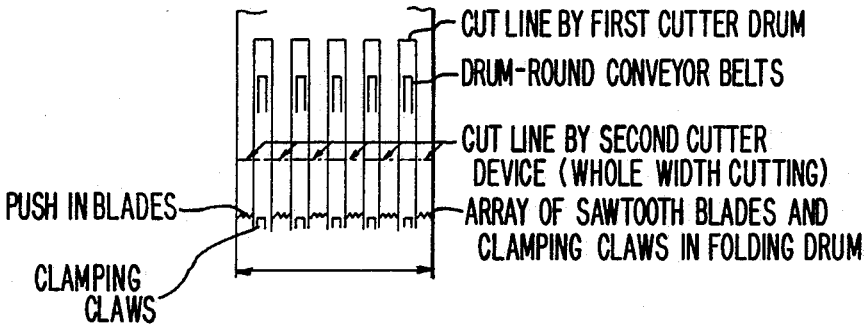
FIG. 2 is a schematic view showing a cutting sequence and cutting locations for a web and an arrangement of clamping claws and push-in blades on a folding drum.
Figure 3:
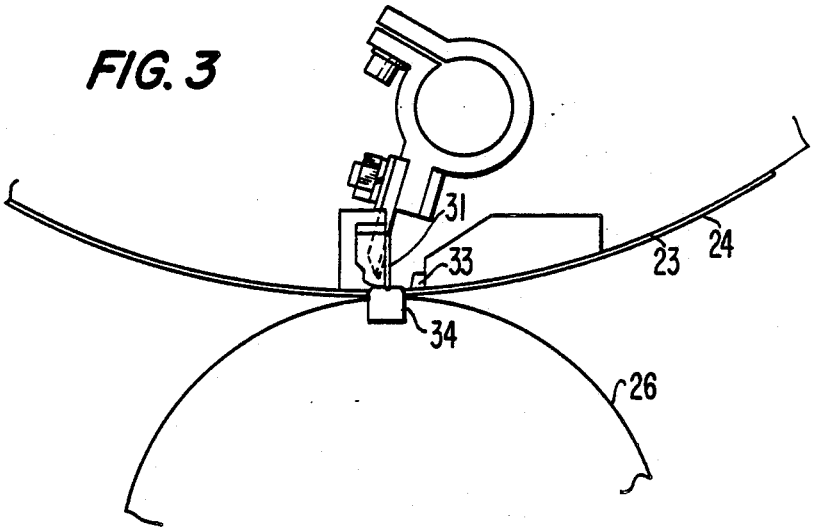
FIG. 3 is an enlarged partial front view showing an engaged condition of relevant devices on a folding drum and a second cutter receiver drum, respectively.
Figure 4:
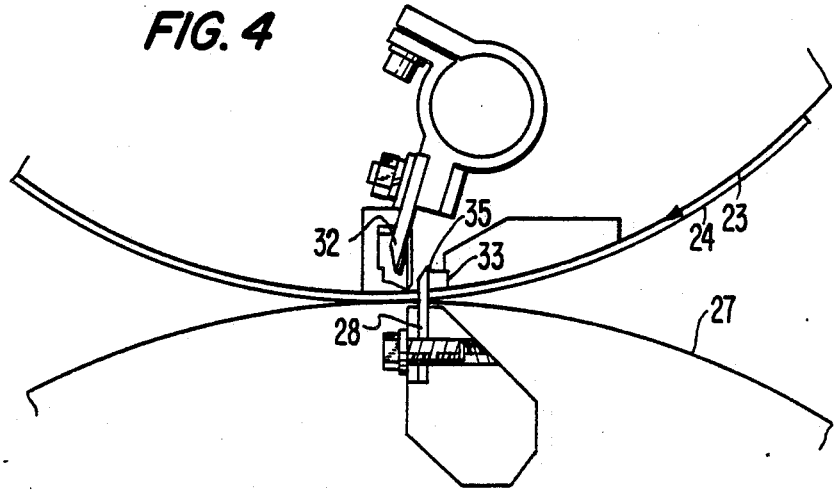
FIG. 4 is an enlarged partial front view showing an engaged condition of relevant devices on a folding drum and a head end push-in drum, respectively.
Figure 5:
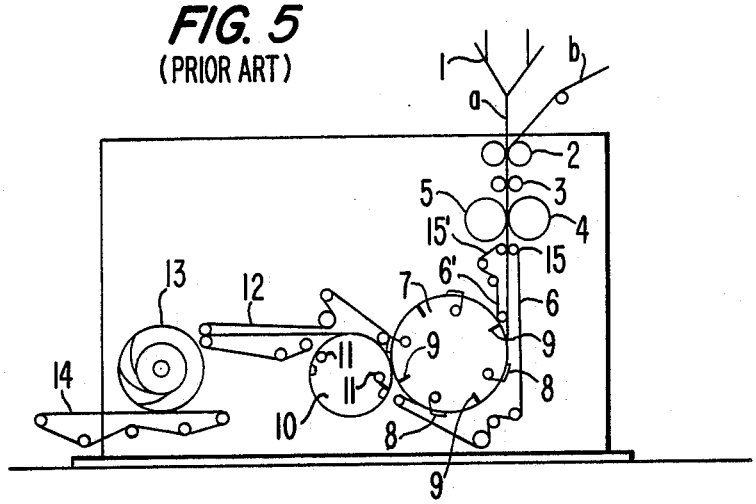
FIG. 5 (PRIOR ART)
FIG. 5 is a schematic front view showing a drum arrangement in a folding machine in the prior art.
Figure 6:
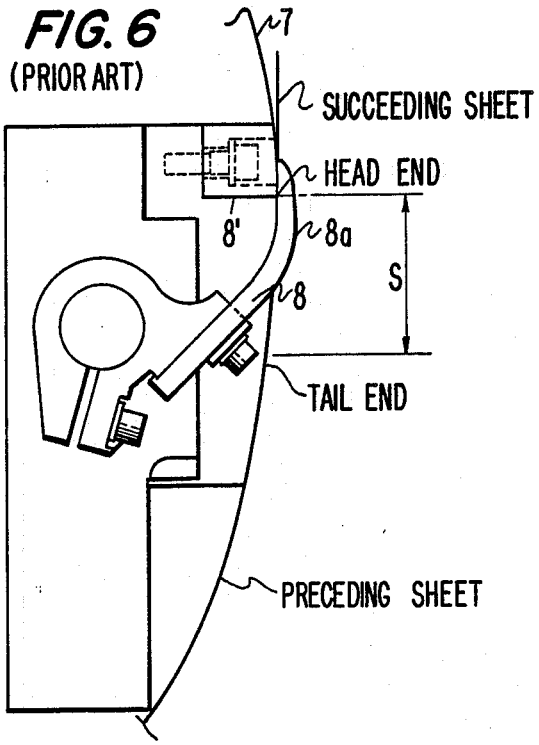
FIG. 6 (PRIOR ART)
FIG. 6 is an enlarged partial front view showing a web head end clamping device on a folding drum.

As shown in FIGS. 1, 3 and 4, either a web a twice-folded by a triangular plate 1 or a web b in an unfolded state passes through the first nipping rollers 2, and after it has been discontinuously cut as shown in FIG. 2 by means of a first cutting device consisting of the first cutter drum 21 and the first cutter receiver drum 22, it passes through the second nipping rollers 3 and enters the folding drum 23. Around the folding drum 23 are disposed a plurality of narrow drum-round conveyor belts 24 as shown in FIG. 2, and the web travels around the folding drum 23 as being pinched between the folding drum 23 and the drum-round conveyor belt 24. As shown in FIG. 2, the width portions of the web not cut by the above-mentioned first cutting device are cut by the saw-tooth cutter blades 31 of the second cutter device 25 disposed on the folding drum 23 and the cutter receiver 34 on the second cutter receiver drum 26 while being constrained by the drum-round conveyor belts 24 (the drumround conveyor belts 24 being disposed on the width portions cut by the aforementioned first cutting device), and therefore, the entire width of the web has been cut now into a cut paper sheet. The head end 35 of the web cut into the cut paper sheet is pushed into the gaps between the plurality of clamping claws 32 and the claw seats 33 disposed at the same position as the sawtooth cutter blade 31 mounted to the second cutter device 25, by means of the push-in blade 28 on the head end push-in drum 27 which blade is notched so as not to interfere with the drum-round conveyor belts 24, as shown in FIG. 2 (reference should be made also to FIGS. 3 and 4). At this moment, since there is nothing to interfere with the push-in operation in the neighborhood of the clamping claws 32 within the folding drum 23, the head end 35 of the web can be smoothly pushed into the folding drum 23. In addition, on the folding drum 23, the sawtooth cutting blade 31, the clamping claws 32 and the claw seats 33 are disposed as aligned straightly in a row in the axial direction of the folding drum 23, and the web head end 35 pushed into the gaps between the clamping claws 32 and the claw seats 33 are pinched and clamped by these members.

The thus clamped web advances further in the circumferential direction of the folding drum 23 as carried thereby, and like the known technique, after the central portion of the cut sheet has been folded and inserted into the clamping device 11 on the clamping drum 10 by means of the folding blade device 29 disposed on the folding drum 23, the clamping claws 32 which have clamped the web head end 35 are opened, and the sheet is separated from the folding drum 23. The folded sheets are carried out to the outside of the folding machine by means of the sheet conveyor belts 12, the sheet discharge impeller 13 and the sheet discharge conveyor 14.

The respective drums 21, 22, 23, 26, 27 and 10 the drum-round belt 24 and the conveyor belts 12 are rotating or revolving at the same speed as the web speed.

As will be apparent from the detailed description of one preferred embodiment of the present invention above, the uniform speed pinless folding machine according to the present invention offers the following advantages:

(1) As the web is conveyed by clamping its head end by means of clamping claws contained in a folding drum, the web is made to travel at a uniform speed without being accelerated and can be discharged after having been subjected to parallel folding, and hence, faults such as end folding, a poor folding precision, etc. are remarkably decreased.

(2) Since the web is wrapped around the folding drum before it is perfectly cut over its entire width and it is cut after the web has been constrained between the drum-round conveyor belt and the folding drum, cutting positions would not fluctuate, and since no portion of the web is freed in distinction from the case where the web is conveyed as pinched between a pair of belts, end folding would not occur.

(3) Owing to the fact that there is no need to make the web slip with respect to the speed-up conveyor belts, belt faults such as belt scratches would not arise on a printed web. Moreover, as generation of static electricity is also little, deterioration of a folding precision would not occur, and reform of discharged folded paper sheets is also easy.

(4) As the speed-up conveyor belts are unnecessary, adjustment of a belt pressure is unnecessary and clogging of paper would not occur, so that an operability of the folding machine is excellent.

While a principle of the present invention has been described above in connection to one preferred embodiment of the invention, it is a matter of course that many apparently widely different embodiments of the present invention could be made without departing from the spirit of the present invention.

I claim:

1. An apparatus for cutting into successive sheets at least one web of material supplied at a speed of movement, said apparatus comprising:

first cutter means for receiving the web and for cutting across a portion only of the width thereof at a cutting position at which a sheet is to be formed by being cut from the sheet;

a first drum positioned downstream of said first cutter means relative to the direction of movement of the web and adapted to receive the web about a portion of its periphery, said first drum having inwardly of said periphery thereof means for clamping the leading end of the web;

conveyor belt means cooperating with said first drum for pressing against said portion of said periphery thereof only that portion of the width of the web cut by said first cutter means, said conveyor means traveling at the same speed as the peripheral speed of said first drum;

means for pushing the leading end of the web into said first drum, whereupon said clamping means grips the leading end of the web; and second cutter means, positioned upstream of said pushing means relative to the direction of movement of the web, for cutting at the cutting position of the web that portion of the web not cut by said first cutting means, and thereby for forming a cut sheet separated from the web.

2. An apparatus as claimed in claim 1, wherein said first cutter means comprises a cutter drum and a cutter receiver drum.

3. An apparatus as claimed in claim 1, wherein said first cutter means comprises means for forming through the web plural cuts separated by uncut web portions.

4. An apparatus as claimed in claim 3, wherein said conveyor belt means comprise plural conveyor belts each operable to press against said first drum a respective portion only of the web cut by said first cutter means.

5. An apparatus as claimed in claim 1, wherein said pushing means comprises a head end push-in drum rotatable at the same peripheral speed as said first drum and having at least one push-in member for pushing the leading end of the web into said first drum.

6. An apparatus as claimed in claim 1, wherein said second cutter means comprises a cutter receiver drum rotatable at the same peripheral speed as said first drum, and cutting means on said first drum and cooperable with said cutter receiver drum.

7. An apparatus as claimed in claim 6, wherein said cutter receiver drum includes a plurality of cutter receivers spaced axially of said cutter receiver drum, and said cutting means comprises a plurality of blades spaced axially of said first drums and cooperable with respective said cutter receivers.

8. An apparatus as claimed in claim 1 forming a portion of a pinless folding machine for folding cut sheets separated from the web, wherein said first drum comprises a folding drum of said pinless folding machine.

* * * * *